United States Patent [19]

Wood

[11] 4,079,639

[45] Mar. 21, 1978

[54] TORQUE WRENCH

[75] Inventor: Harold Leslie Wood, Footscray, Australia

[73] Assignee: Repco Limited, Australia

[21] Appl. No.: 730,009

[22] Filed: Oct. 6, 1976

[30] Foreign Application Priority Data

Oct. 8, 1975 Australia ..... 3490/75

[51] Int. Cl.[2] ..... B25B 23/14

[52] U.S. Cl. ..... 81/52.4 R

[58] Field of Search ..... 81/52.4 R, 52.5

[56] References Cited

U.S. PATENT DOCUMENTS

| | | | |
|---|---|---|---|
| 2,732,747 | 1/1956 | Livermont | 81/52.5 |
| 2,743,638 | 5/1956 | Woods | 81/52.4 R |
| 2,900,855 | 8/1959 | VanHoose | 81/52.4 R |
| 3,608,403 | 9/1971 | Green | 81/52.5 |
| 3,763,724 | 10/1973 | Green | 81/52.4 R |

*Primary Examiner*—James L. Jones, Jr.
*Attorney, Agent, or Firm*—Stevens, Davis, Miller & Mosher

[57] ABSTRACT

A torque wrench of the "break" type in which the handle moves relative to the workhead when the preselected tension has been reached, thereby providing a signal which can be felt by the user. The handle is pivotally connected to the workhead, and a tension control mechanism acts between the handle and workhead to prevent pivotal movement of the handle in one direction relative to the workhead until the preselected tension has been reached. The tension control mechanism is adjustable to allow variation of the "break torque," and includes a lever which is pivotally connected to the workhead and coacts with a reaction member connected to the handle. A spring influenced plunger acts on the lever through a toggle bar to hold the lever in an operative position, at which position the handle is held against pivotal movement relative to the workhead, and the toggle bar has its longitudinal axis at an angle to the longitudinal axis of the plunger. When the preselected tension is reached the lever swings about its pivot causing the toggle bar to move closer towards axial alignment with the plunger thereby reducing resistance to pivotal movement of the handle relative to the workhead. Adjustment of the preselected tension is achieved by altering the position of engagement between the lever and reaction member relative to the pivotal axis of the lever.

10 Claims, 9 Drawing Figures

TORQUE WRENCH

This invention relates to torque wrenches as used to produce a preselected tension between two interengaging screw threaded parts such as a stud and nut. In particular, the invention is concerned with such wrenches which provide a signal when the preselected tension has been reached, and which are adjustable to permit variation of the tension at which the signal occurs.

Wrenches of the aforementioned kind are generally of complex construction and suffer a lack of accuracy. Adjustment of the operating or "signal" tension in prior art wrenches is commonly achieved by varying the loading on a spring, and consequently its effective length. The accuracy of such a wrench rests on the assumption that the spring force will always be the same at each selected length of the spring, but that is not so in practice because of the effect of ambient conditions and the loss of resilience through fatigue. Also, such wrenches include a substantial number of moving parts (see for example U.S. Pat. No. 2,732,747, granted to F. W. Livermont Jan. 31, 1956) and the frictional resistance to relative movement of the parts will vary with spring pressure, thereby affecting accuracy. Still another disadvantage is the difficulty of adjusting the wrench against a relatively high spring force, and it is sometimes necessary to use a tommy-bar or other aid to effect the adjustment.

It is a principal object of the present invention to provide a torque wrench of the kind indicated which is relatively simple in construction and is accurate and effective in operation. It is a further object of the invention to provide a torque control module for such torque wrenches, whereby the range of operating tensions of a wrench can be varied by interchanging one module for another.

A wrench in accordance with the invention is of the break-type — i.e., at the preselected tension, there is a sudden release of the torque applied to the tool head through the handle of the wrench, so that the user feels the wrench give, thereby providing the signal that the preselected tension has been reached. It is a feature of the wrench that the operating tension is adjustable by varying the relative positions of two cooperable reaction members which interact with the wrench handle, and that, at the preselected tension, one of those members overcomes a bias force which is substantially constant for all adjustments of the wrench.

The invention may be applied to torque wrenches of various configurations, including such wrenches as are attachable to a complete spanner or other tool (see for example Australian Patent Specification No. 120,832). As a matter of convenience however, the invention will be particularly described in relation to a wrench having a head for attachment of any one of a series of tubular or socket spanners, or other tool elements. Consequently, reference to "tool head" throughout the following description and claims, is to be understood as embracing a head which accepts sockets or other tool elements which are not usable alone or a head which is attachable to a spanner or other complete tool. In another alternative, the tool head may have the actual tool element formed integral therewith rather than providing for intechangeability as in the other two arrangements described.

According to one aspect of the present invention, there is provided a torque wrench including:

a tool head;

an elongate handle pivotally connected at one end portion to said tool head;

torque control mechanism secured to said tool head and having, a reaction lever pivotally mounted for movement relative to said tool head about an axis substantially parallel to said handle pivot axis, and biasing means acting against said lever through a toggle bar so as to urge said lever into an operative position, the longitudinal axis of said toggle bar being arranged at an angle to the line of force of said biasing means;

a reaction member connected to said handle for movement therewith about said handle pivot and being engageable with said lever at a location spaced from said pivot thereof, said engagement being such as to resist movement of said handle in one direction about said pivot thereof; and adjusting means operable to cause relative movement between said reaction member and said lever so as to place said location closer to or further from said lever pivot.

According to another aspect of the invention, there is provided torque control mechanism for a torque wrench including;

a body section;

a lever pivotally mounted on said body section;

a toggle bar having one end engaging said lever at a position spaced from said lever pivot; and biasing means mounted on said body section and engaging the end of said toggle bar opposite said one end thereof so that said lever is urged about its pivot, through the intermediary of said toggle bar, into an operative position;

said toggle bar being arranged so that its longitudinal axis extends at an angle relative to the line of force of said biasing means, and the engagement with said lever is such that said angle is reduced as said lever is moved away from said operative position against the influence of said biasing means.

The reference to "line of force" in the preceding two paragraphs and subsequent passages of this specification, is to be understood as meaning the central line along which the bias exerts its influence. That is, the line is at the center of the region of influence of the bias and follows the path of travel of that center as the biasing means expands or contracts in use. Taking for example the case of a coiled compression spring, the line of force is therefore central with an end of the spring and is a continuation of the longitudinal axis of the spring, whether that axis be curved or straight.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
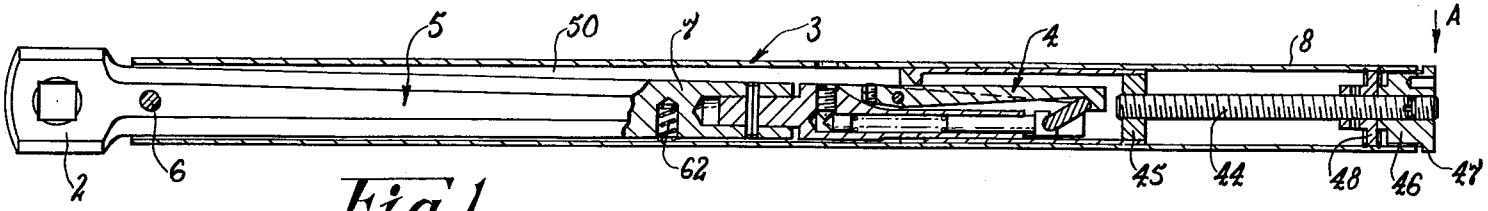
FIG. 1 is a longitudinal cross-sectional view of one form of torque wrench incorporating an embodiment of invention.

A wrench in accordance with the invention and as shown in the attached drawings, includes a tool head 2, and a handle 3 connected to that head through tension control mechanism 4 which permits limited relative movement between the handle 3 and the head 2, but resists such movement below the preselected operating tension of the wrench. In the preferred arrangement shown, the tension control mechanism 4 is formed as a detachable module which can be replaced as desired to vary the operational range of the wrench, but the invention is also applicable to an arrangement in which that mechanism is not interchangeable.

In the arrangement shown, the head 2 is formed integral with one end of a torsion arm 5, and the handle 3 is in the form of a tubular member which contains at least a substantial part of the arm 5 and is connected thereto. The connection comprises a pivotal mounting 6 which is located adjacent the head 2, and the axis of the pivot 6 is substantially parallel with the axis about which the head 2 turns in applying a turning moment to a nut or other screw threaded part. The tension control mechanism 4 is attached to the end 7 of the torsion arm 5 remote from the head 2 so as to be contained within the body of the handle 3, and an outer end portion 8 of the handle 2 projects beyond that mechanism 4 to define a gripping portion.

Figure 4:
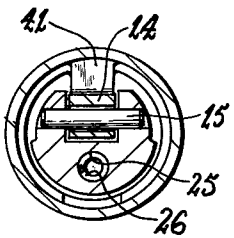
FIG. 4 is a transverse cross-sectional view taken along line IV—IV of FIG. 2.
Figure 2:
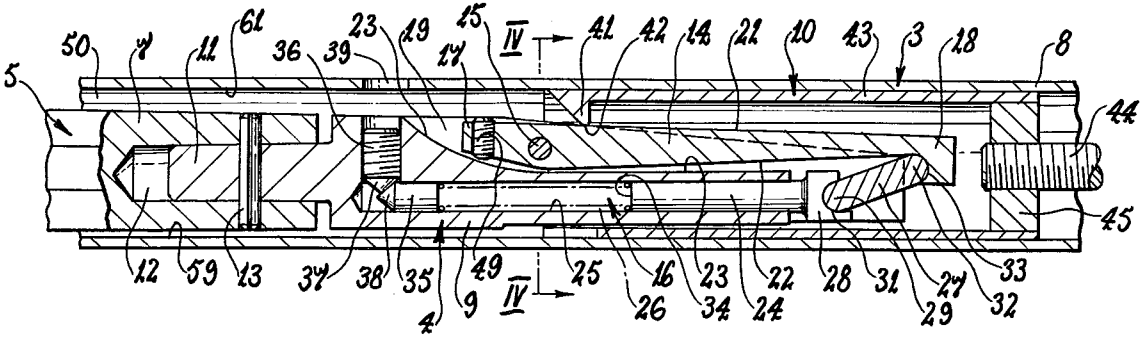
FIG. 2 is an enlarged cross-sectional view of the tension control mechanism of the wrench shown in FIG. 1.
Figure 3:
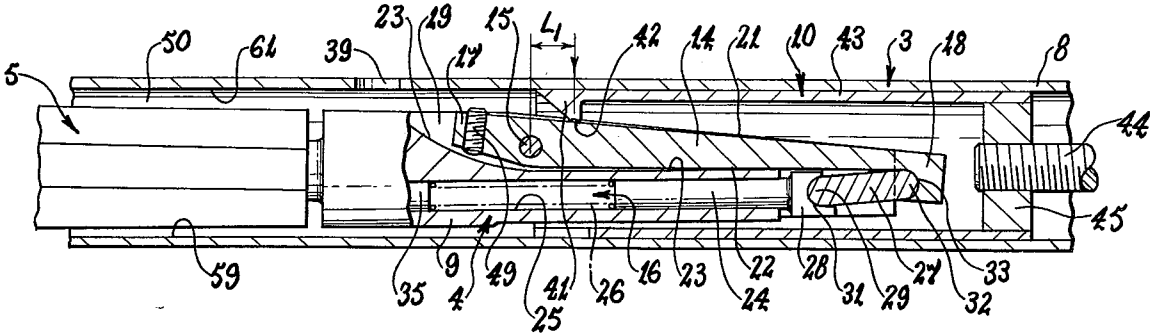
FIG. 3 is a view similar to FIG. 2 but showing the control mechanism after the preset tension has been exceeded.

The tension control mechanism 4, which is best seen in FIGS. 2 to 4, includes a carrier or body section 9, which may be formed integral with the arm 5, but is preferably releasably connected thereto to permit interchangeability as previously discussed. The carrier section 9 supports other components of the mechanism 4 so as to provide a complete and detachable module, and its releasable connection with the arm 5 may be of any suitable form, but is such that in use the carrier section 9 moves with the arm 5 as though it were part of that arm. In the particular construction shown, an end projection 11 of the carrier section 9 locates within a longitudinal bore 12 of the arm 5 and is releasably held in that location by pin 13.

A reaction lever 14 is mounted on the carrier section 9 through pivot 15 and is biased towards an operative position (as shown FIG. 2) by biasing means 16 attached to the carrier section 9 and interacting between that section and the reaction lever 14. The reaction lever 14 forms one of the previously mentioned reaction members, and the other reaction member 10 preferably forms part of or is attached to adjusting means as hereinafter described.

In the foregoing arrangement, the reaction lever 14 is in effect a fixed reaction member because its position longitudinally of the handle 3 is not adjustable, whereas the reaction member 10 is movable. In an alternative arrangement, the reaction lever 14 might be movable lengthwise of the handle 3, in which event the reaction member 10 could be fixed or also adjustable, as desired. The primary requirement is that the zone of engagement between the two reaction members 14 and 10 can be moved away from and towards the lever pivot 15, the axis of which is substantially parallel to the axis of the handle pivot 6.

The reaction lever pivot 15 is preferably adjacent one end portion 17, and the lever 14 extends lengthwise of the handle 3 so that the opposite end 18 is adjacent the outer end 8 of the handle 3. The lever 14 is shown as located within a longitudinally extending groove 19 formed in the outer surface of the carrier section 9, so that a top or radially outer surface 21 of the lever 14 is exposed at one side of the carrier section 9. That exposed surface 21 extends generally in the axial direction of the handle 3 and is engageable by the reaction member 10 as hereinafter described. The opposite or bottom surface 22 of the lever 14 is spaced from the base 23 of the groove 19, and is arranged to permit the lever 14 to swing about its pivot 15 towards and away from that base 23. A stop screw 49 may be provided at the lever end portion 17 so as to engage the groove base 23 and limit outward swinging movement of the lever 14. The maximum outward position of the lever constitutes, or is substantially the same as, the previously mentioned operative position.

The biasing means 16 may take any one of several forms, but in the arrangement shown, includes a plunger 24 slidably mounted in a bore 25 of the carrier section 9, which bore 25 extends generally lengthwise of the handle 3, and a spring 26 or other resilient element urging the plunger 24 towards the handle outer end 8. A toggle bar 27 extends between and coacts with both the plunger 24 and the reaction lever 14 in a manner hereinafter described. A head 28 of the plunger 24 is exposed at that end of the carrier 9 adjacent the handle outer end 8, and a curved end 29 of the toggle bar 27 engages within a substantially complementary seating recess 31 formed in the outer end of the head 28. The opposite end 32 of the toggle bar 27 is also curved and engages within a substantially complementary seating recess 33 formed in a downward projection of the reaction lever end 18. The recess 33 faces back towards the tool head 2, and is spaced further from that head than is the plunger recess 31. The arrangement is such that, in the operative position of the reaction lever 14, the toggle bar 27 extends away from the plunger head 28 angularly towards the lever top surface 21, and therefore has its longitudinal axis at an angle to the line of force of the biasing means 16. In the arrangement shown, that line of force is in effect a continuation of the longitudinal axis of plunger 24.

A coil compression spring is preferably used as the resilient element 26, and as shown, that spring may be interposed between an inner end 34 of the plunger 24 and a backing element 35 which is slidable within the bore 25 and is retained in a particular position by a calibration screw 36 (see FIG. 2). The calibration screw 36 is mounted in the carrier section 9 so that a conical end surface 37 protrudes into the bore 25 and engages with the end surface 38 of the backing element 35 remote from the spring 26, which end surface 38 may be conical also. Thus adjustment of the position of screw 36 affects the spring force existing at the operative position of the reaction lever 14, and in that way the tension control mechanism can be calibrated. If desired, the calibration screw 36 may be accessible from the outside of the handle 3 through an opening 39. Quite obviously, the calibration screw 36 may be arranged to adjust the spring force in a manner different to that particularly described.

In the particular arrangement of FIGS. 1 to 4, the reaction member 10 includes a rib, lug, or other projection 41 having an end surface 42 arranged for engagement with the top surface 21 of the reaction lever 14 at a location between the reaction lever pivot 15 and the lever end 18. The area of that engagement is determined by the size of the end surface 42, and that may be relatively small. In the construction shown, the projection 41 is formed at one end of a sleeve 43 slidably mounted in the tubular handle 3, and which forms part of the adjusting means. The sleeve 43 is preferably a neat sliding fit in the tubular handle 3, and contains a portion of the tension control mechanism 4 so that the projection 41 overlies the reaction lever 14.

Any suitable means may be employed to adjust the position of the sleeve 43 (see FIG. 1) longitudinally of the handle 3. In the construction shown however, the adjusting means includes a screw threaded spindle 44 which is secured to an end wall 45 of the sleeve 43 so as to extend axially away from that wall, and cooperatively engages within a nut 46 mounted within the tubular handle 3 at its outer end 8. A part 47 of the nut 46 is located externally of the handle 3 to facilitate gripping for rotation, and the inner face of the nut 46 bears against a collar 48 secured within the handle 3.

Figure 6:
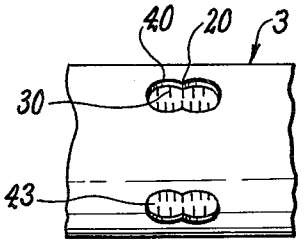
FIG. 6 is a view of part of the exterior surface of the wrench shown in FIG. 5 and taken in the direction of arrow VI—VI of FIG. 5.

Visual indication of the adjustment position of the wrench may be achieved by providing a window opening 40 in the wall of the tubular handle 3 so as to expose part of the sleeve outer surface of sleeve 43, and having a suitable scale 30 marked on that surface (see FIG. 6). A pointer may comprise an element 20 secured within the window opening, or forming part of that opening as shown in FIG. 6, or an appropriate marking on the tubular body at the side of the opening 40.

The various components described are arranged in such a manner that, when the tension control mechanism 4 is in the operative position (FIGS. 1 and 2), the torsion arm 5 lies close to and may engage one side 59 of the tubular handle 3, which is the side remote from the reaction member projection 41. A clearance space 50 exists between the opposite side 61 of the handle 1 and the arm 5, whereby the arm 5 can be swung through a limited distance about the pivot 6 relative to the tubular handle 3. The tension control mechanism 4 forms a continuation of the arm 5 and is therefore similarly disposed relative to the tubular handle 3, and resists the aforementioned relative swinging movement of the arm 5 because of its engagement with the reaction member 10. Preferably, the two reaction members 14 and 10 engage when the reaction lever 14 is in its operative position and the side of the carrier section 9 remote from the lever 14 engages or lies close to the adjacent surface of the tubular handle 3 and/or the sleeve 43. If desired, the arm 5 may be biased by a spring 62 (see FIG. 1) or other means to maintain engagement between the reaction members 10 and 14.

In use, a force is applied to the handle 3 whereby it tends to swing about the pivotal connection 6 with the torsion arm 5, in the direction of arrow A of FIG. 1, which is such as to reduce the clearance space 50. That force results in a turning moment being applied to the reaction lever 14 because of its engagement with the reaction member projection 41, which is effectively part of the handle 3 in that it moves with the handle 3 about the pivotal connection 6. The applied turning moment is resisted however, by the bias applied to the outer end of the reaction lever 14 through the intermediary of the toggle bar 27.

When the applied force reaches a particular magnitude however, the aforementioned bias will be inadequate to resist the turning moment of the reaction lever 14, which will then swing about its pivotal mounting 15 in the general direction of the applied force. As a result of that swinging movement, the toggle bar 27 will progressively pivot about the end 29 engaging the plunger head 28 towards a position at which it extends at least of an angle to the longitudinal axis of the plunger 24 (see FIG. 3). That movement is resisted by the biasing spring 26, but when the toggle bar 27 is moved slightly from the position shown in FIG. 2, the resistance drops dramatically for a reason hereinafter explained, with the result that the lever 14 snaps quickly into the limit position shown in FIG. 3. That sudden movement of the lever 14 is naturally magnified by movement of the handle 3 about the pivot 6, which movement is felt by the user so providing a signal that the preselected tension has been reached, but there might be an audible signal also because of the lever 14 hitting against the groove base 23.

Figure 8:
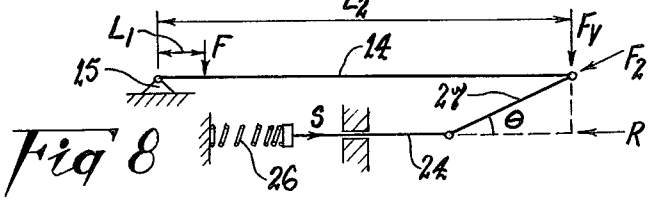
FIG. 8 is a force diagram representing conditions existing in FIG. 2.
Figure 9:
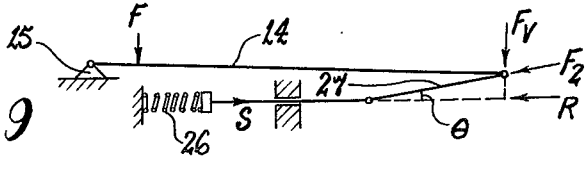
FIG. 9 is a force diagram representing conditions existing in FIG. 3.

The sudden and sharp loss of resistance to movement of the handle 3 about pivot 6 can be best understood by reference to the force diagrams shown in FIGS. 8 and 9, which are representative of the conditions shown in FIGS. 2 and 3 respectively. When a turning force is applied to the handle 3 in direction of arrow A shown in FIG. 1, a force F is applied to lever 14 by its engagement with the projection 41 of reaction member 10. Downward swinging movement of lever 14 is resisted however, by the system comprising toggle bar 27, plunger 24 and spring 26. As the toggle bar 27 is pivotally connected to both the lever 14 and plunger 24, a longitudinal force $F_2$ is set up in that bar in response to the turning moment applied to the lever 14. That is, a downward force $F_v$ is applied at the point of connection between the lever 14 and toggle bar 27, and the force $F_2$ is directly proportional to $F_v$. The resultant R of the force $F_2$ acts in the axial direction of plunger 24 and is resisted by spring force S. It will be appreciated that the aforementiond system remains "rigid" while the magnitude of force R is less than that of spring force S.

As the magnitude of F is increased because of a greater turning force applied to the handle 3, the resultant force R also increases, and downward movement of lever 14 commences when R exceeds S. In view of the difference between lever arms $L_1$ and $L_2$ (FIG. 8), the small downward movement at F is magnified considerably at $F_v$ (FIG. 9). Thus, there is a dramatic reduction in the angle $\theta$ defined between the axes of toggle bar 27 and plunger 24, and as a consequence there is a substantial increase in R even though force F (and consequently $F_v$) remains unchanged.

In order to illustrate the foregoing, it will be assumed that lever 14 moves through approximately $2\frac{1}{2}°$ in going from the FIG. 8 to the FIG. 9 condition, and that angle $\theta$ changes from approximately 25° to approximately 10°. It will be also assumed that F is constant in both cases, and consequently the downward component $F_v$ of force $F_2$ is also constant because it has a direct relationship with force F. In both the FIG. 8 and FIG. 9 conditions, the resultant force R equals $F_v \cot. \theta$. Since cot.

25° is 2.15 and cot. 10° is 5.671, the force R of the FIG. 9 condition is approximately 2.65 times greater than R in the FIG. 8 condition. It will therefore be appreciated that there will be a significant loss of resistance at the commencement of movement of lever 14 from the FIG. 8 condition, and that loss of resistance will rapidly increase as the lever 14 moves through the relatively short distance existing between the FIG. 8 and FIG. 9 conditions. The user of the wrench will therefore easily feel the loss of resistance and realize that the preselected tension has been reached.

Figure 5:
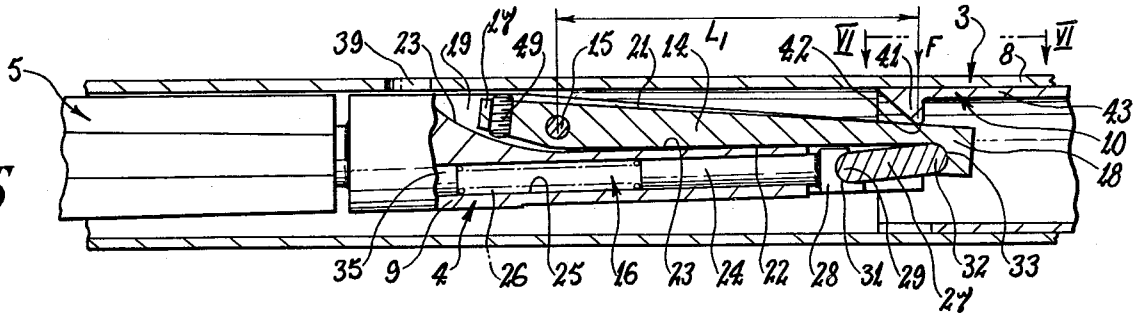
FIG. 5 is a view similar to FIG. 3 but showing the wrench at a different stage of adjustment.

The force F necessary to achieve the torque break condition will be determined by the length $L_1$ of the lever arm between the pivotal mounting 15 and the zone of engagement between the lever 14 and the reaction member 10. A relatively high force is required if that length is short as shown in FIGS. 1 to 4 and 8, and consequently the relative movement between the handle 3 and torsion arm 5 will be relatively small under those conditions, whereas it will be relatively large if the lever arm $L_1$, is long — i.e., the preselected tension is low — as shown in FIG. 5. That feature makes the wrench safer to use than most prior art wrenches which have increased free movement under the break condition as the break force increases, and the user is therefore likely to be thrown off balance when the break condition is reached.

Figure 7:
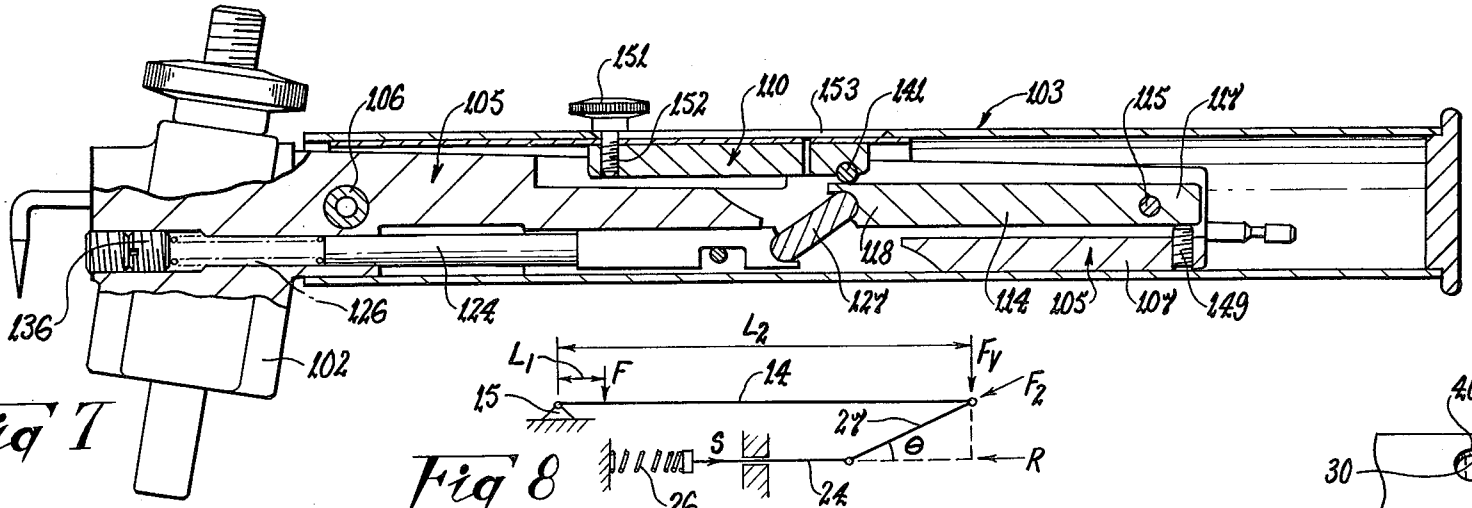
FIG. 7 is a longitudinal cross-sectional view of another embodiment of the invention.

FIG. 7 illustrates another possible embodiment of the invention, and for convenience parts of that arrangement which correspond to parts of the previously described arrangement, will be given like reference numerals but in the series 100 to 199. One of the main differences in the FIG. 7 arrangement is that the lever 117 extends back along the tension arm 105 rather than away from that arm, and a separate carrier section is therefore not required. Also, the calibration screw 136 is accessible at an end of the wrench rather than through a side as in the previous arrangement. Another difference is the form of the reaction member 110 and its projection 141, and the manner in which the position of projection 141 is adjusted. Such adjustment is achieved by means of a clamp screw 151 having a stem 152 projecting through a slot 153 in the wall of the handle 103 and threadably engaging with the body of member 110. Thus, adjustment of the screw 151 along the length of slot 153 controls the position of the projection 141.

Operation of the FIG. 7 arrangement is substantially the same as in the previous arrangement, and FIG. 7 shows the wrench adjusted for low tension with the lever 141 in the operative position. When the turning force applied to the handle 103 causes the preselected tension to be exceeded, the lever 114 swings about pivot 115 with resultant loss of resistance at the end 118 as in the previous construction.

It will be readily apparent that the invention has several other advantages over the prior art. For example, the bias spring 26 is maintained at a constant spring force after the initial adjustment for calibration purposes, and adjustment of the break torque is relatively simple as it does not require a spring force or other substantial resistance to be overcome. Still further, the ability to interchange tension control modules 4 permits the working range of the wrench to be varied at will - i.e., several modules having a different spring force may be available to cover different working ranges. Yet another advantage is the simplicity of the wrench, which employes a minimum of moving parts. The wrench is also extremely accurate because its adjustment depends upon a simple lever arm system rather than variation of a spring force as in prior constructions.

Although the invention has been described as residing in a complete wrench, it is to be understood that it also resides in a tension control module for use with a wrench.

Various alterations, modifications and/or additions may be incorporated into the invention as particularly described or shown, without departing from the spirit or scope of the invention as defined by the appended claims.

I claim:

1. A torque wrench including: a tool head; an elongate handle pivotally connected at one end portion to said tool head; torque control mechanism secured to said tool head and having, a reaction lever pivotally mounted for movement relative to said tool head about an axis substantially parallel to said handle pivot axis, a toggle bar engaging said lever at a location spaced from said lever pivot, and biasing means acting against said lever through said toggle bar so as to urge said lever into an operative position at which the longitudinal axis of said toggle bar is arranged at an angle to the line of force of said biasing means; a reaction member connected to said handle for movement therewith about said handle pivot and being engageable with said lever at a location spaced from said pivot thereof, said engagement being such that movement of said handle in one direction about said pivot thereof causes said lever to swing away from said operative position against the influence of said biasing means, and said toggle bar responds to said lever movement by moving to progressively reduce the angle subtended between the toggle bar longitudinal axis and said line of force; and adjusting means operable to cause relative movement between said reaction member and said lever so as to vary the distance between said lever pivot and the location of said engagement of said reaction member and lever.

2. A torque wrench according to claim 1, wherein said torque control mechanism is detachable from said tool head so as to be removable from said wrench.

3. A torque wrench according to claim 1, wherein said torque control mechanism includes a carrier section which is rigidly secured to said tool head and carries said lever, biasing means, and toggle bar.

4. A torque wrench according to claim 3, wherein said biasing means includes a spring influenced plunger which is slidably mounted on said carrier section and engages said toggle bar at one end thereof.

5. A torque wrench according to claim 4, wherein calibration means is provided to enable selective variation of the spring force acting on said plunger.

6. A torque wrench including:

a tool head;

an elongate handle which is hollow for at least part of its length and is pivotally connected at one end portion to said tool head, the axis of pivotal connection being substantially parallel to the axis about which said tool head is turned when in use;

a torsion arm rigidly secured to said tool head and extending into said handle in a direction away from said pivotal connection;

torque control mechanism secured to the end of said arm which is remote from said tool head and having, a reaction lever pivotally mounted for movement relative to said arm about an axis substantially parallel to said handle pivot axis, a toggle bar engaging said lever at a location spaced from said lever pivot, and biasing means acting against one end portion of said lever through said toggle bar and having its longitudinal axis arranged at an angle to the line of force of said biasing means;

a reaction member mounted on said handle for movement therewith about said handle pivot and being engageable with said lever at a location between said pivot and end portion thereof, said engagement being such that movement of said handle in one direction about said pivot thereof causes said lever to swing away from said operative position against the influence of said biasing means, and said toggle bar responds to said lever movement by moving to progressively reduce the angle subtended between the toggle bar longitudinal axis and said line of force; and adjusting means which is operable to move said reaction member relative to said handle to place said location closer to or further from said lever pivot.

7. Torque control mechanism for a torque wrench including:

a body section;

a lever pivotally mounted on said body section;

a toggle bar having one end engaging said lever at a position spaced from said lever pivot; and biasing means mounted on said body section and engaging the end of said toggle bar opposite said one end thereof so that said lever is urged about its pivot, through the intermediary of said toggle bar, into an operative position at which the longitudinal axis of said toggle bar is arranged at an angle to the line of force of said biasing means, the engagement between said lever and said toggle bar being such that, when said lever is pivoted away from said operative position against the influence of said biasing means, said toggle bar responds by moving to progressively reduce the angle subtended between the toggle bar longitudinal axis and said line of force.

8. A torque control mechanism according to claim 7, wherein said biasing means includes a plunger slidably mounted in a bore of said body section and having one end engaging said opposite end of the toggle bar, and a spring acting against said plunger to urge it into engagement with said toggle bar.

9. A torque control mechanism according to claim 8, wherein calibration means is provided to permit selective adjustment of the force applied to said plunger by said spring.

10. A torque control mechanism according to claim 7, wherein said toggle bar pivots about both of its ends during movement of said lever away from or towards said operative position.

* * * * *